US007931529B2

(12) United States Patent
Yacenda

(10) Patent No.: US 7,931,529 B2
(45) **Date of Patent: *Apr. 26, 2011**

(54) SYSTEM AND METHOD FOR OPERATING ON-LINE GOVERNMENTAL LOTTERY GAMES

(75) Inventor: Michael W. Yacenda, Stamford, CT (US)

(73) Assignee: Elottery, Inc., Stamford, CT (US)

( * ) Notice: Subject to any disclaimer, the term of this patent is extended or adjusted under 35 U.S.C. 154(b) by 137 days.

This patent is subject to a terminal disclaimer.

(21) Appl. No.: 11/071,607

(22) Filed: Mar. 3, 2005

(65) Prior Publication Data

US 2005/0143163 A1 Jun. 30, 2005

Related U.S. Application Data

(63) Continuation of application No. 10/000,795, filed on Nov. 2, 2001, now Pat. No. 6,869,358, which is a continuation-in-part of application No. 09/458,326, filed on Dec. 10, 1999, now Pat. No. 6,322,446.

(51) Int. Cl.
*A63F 9/24* (2006.01)

(52) U.S. Cl. ..... 463/17; 463/16; 463/18; 463/25; 463/29; 463/40; 463/42

(58) Field of Classification Search ..... 463/16–19, 463/25, 29, 30–31, 40–43
See application file for complete search history.

(56) References Cited

U.S. PATENT DOCUMENTS 4,713,837 A 12/1987 Gordon
4,815,741 A 3/1989 Small
4,842,278 A 6/1989 Markowicz
4,922,522 A 5/1990 Scanlon
5,083,272 A 1/1992 Walker et al.
5,326,104 A 7/1994 Pease et al.
5,646,839 A 7/1997 Katz
5,954,582 A 9/1999 Zach
(Continued)

FOREIGN PATENT DOCUMENTS

CA 2 269 851 10/2000
(Continued)

OTHER PUBLICATIONS

European Search Report from EP 01 98 6080.
(Continued)

*Primary Examiner* — Peter DungBa Vo
*Assistant Examiner* — Sunit Pandya
(74) *Attorney, Agent, or Firm* — F. Chau & Associates, LLC

(57) ABSTRACT

The present invention relates to a system and a method for facilitating governmental lottery games with a screening, a verification, and a subscription play function. A lottery agent system of the present invention includes a plurality of player terminals on which lottery players can play lottery games, including purchasing and receiving lottery tickets, an agent server for facilitating the purchase and screening of players and winning tickets, and a governmental lottery administrator for providing security or serial numbers for verification. The present invention further discloses a method for claiming awards for the winning tickets upon a drawing of winning numbers. Upon receiving information of the winning tickets, the state provides the agent server with claim validation numbers associated with the winning tickets for claims on lottery awards by winning players.

20 Claims, 4 Drawing Sheets

U.S. PATENT DOCUMENTS

| | | | | |
|---|---|---|---|---|
| 5,979,894 | A | 11/1999 | Alexoff | |
| 6,017,032 | A * | 1/2000 | Grippo et al. | 273/138.1 |
| 6,024,640 | A | 2/2000 | Walker et al. | |
| 6,024,641 | A * | 2/2000 | Sarno | 463/17 |
| 6,069,890 | A | 5/2000 | White et al. | |
| 6,080,062 | A | 6/2000 | Olson | |
| 6,086,477 | A * | 7/2000 | Walker et al. | 463/17 |
| 6,102,400 | A | 8/2000 | Scott et al. | |
| 6,146,272 | A | 11/2000 | Walker et al. | |
| 6,154,172 | A * | 11/2000 | Piccionelli et al. | 342/357.1 |
| 6,168,521 | B1 * | 1/2001 | Luciano et al. | 463/18 |
| 6,183,361 | B1 | 2/2001 | Cummings et al. | |
| 6,251,016 | B1 | 6/2001 | Tsuda et al. | |
| 6,277,026 | B1 * | 8/2001 | Archer | 463/42 |
| 6,383,078 | B1 | 5/2002 | Yacenda | |
| 6,599,186 | B1 | 7/2003 | Walker et al. | |
| 6,761,633 | B2 | 7/2004 | Riendeau et al. | |
| 6,869,358 | B2 * | 3/2005 | Yacenda | 463/17 |
| 6,874,783 | B2 | 4/2005 | Higginson et al. | |
| 2001/0003100 | A1 | 6/2001 | Yacenda | |
| 2001/0029487 | A1 | 10/2001 | Kwon | |
| 2001/0031661 | A1 | 10/2001 | Wiltshire et al. | |
| 2002/0147049 | A1 | 10/2002 | Carter, Sr. | |
| 2003/0023547 | A1 * | 1/2003 | France et al. | 705/39 |
| 2004/0259626 | A1 * | 12/2004 | Akram et al. | 463/17 |
| 2005/0153779 | A1 | 7/2005 | Ziegler | |
| 2005/0215306 | A1 * | 9/2005 | O'Donnell et al. | 463/17 |
| 2007/0060284 | A1 | 3/2007 | Yacenda | |

FOREIGN PATENT DOCUMENTS

| | | |
|---|---|---|
| WO | WO 95/10098 | 4/1995 |
| WO | WO 98/26361 | 6/1998 |
| WO | WO 01/18759 | 3/2001 |
| WO | WO 01/48712 | 7/2001 |
| WO | WO 01/48713 | 7/2001 |
| WO | WO 01/70359 | 9/2001 |
| WO | WO 01/71677 | 9/2001 |

OTHER PUBLICATIONS

International Search Report dated Sep. 22, 2009.
Statement of Grounds and Particulars in Support of Opposition dated Oct. 2, 2009 by South Wales Lotteries Corporation.
Statement of Grounds and Particulars in Support of Opposition dated Sep. 25, 2009 by Manaccom Corporation Ltd.
Dreams Come true website (www.dreamscometrue.com.au).
International Search Report.
US 5,823,877, 10/1998, Scagnelli et al. (withdrawn)

* cited by examiner

SYSTEM AND METHOD FOR OPERATING ON-LINE GOVERNMENTAL LOTTERY GAMES

RELATED APPLICATION DATA

This present application is a continuation of application Ser. No. 10/000,795 filed Nov. 2, 2001, now issued as U.S. Pat. No. 6,869,358, which is a continuation-in-part of commonly assigned application Ser. No. 09/458,326, filed on Dec. 10, 1999, now issued as U.S. Pat. No. 6,322,446.

FIELD OF THE INVENTION

The present invention relates to a system and a method for playing lottery games via an electronic network, and more particularly to a system and a method for operating or facilitating on-line state lottery games.

BACKGROUND OF THE INVENTION

In traditional lottery games, lottery players walk into convenience retailers, manually fill out selection slips, and exchange cash or credit with a clerk, who then enters the selections into a lottery terminal. This lottery terminal electronically connects to a central lottery system which manages the lottery games. The central game system then issues a coded lottery ticket, and the lottery ticket is delivered to the lottery players through the local lottery terminal at the retailer. To play lottery games administered by governmental entities such as countries, states, provinces or multi-state lottery associations, lottery players are required to travel to retailers and sometimes wait in line to purchase lottery tickets.

Numerous interactive games on the Internet are now available. These include both games of skill or games of chance (wager) such as virtual casinos. However, lottery games such as lotteries offered by the governmental entities have not been made available on the Internet. One reason may be concern regarding security and fraud as to forged winning tickets. Also, it may be more difficult to verify play criteria such as the age or residence of the lottery players. If governmental entities' lottery tickets can be purchased by players over publicly accessible electronic or telephonic network such as the Internet, it can be anticipated that many more players will participate in the lottery. Many more tickets will be sold and awards will be much larger. If online lottery play of a governmental lottery is possible, other features such as subscription play wherein players subscribe to a periodic play of same numbers can be added, thereby making lottery gaming even more attractive.

Therefore, a need exists for a lottery agent system which facilitates lottery play of governmental lotteries via an electronic network such as through the Internet. A need also exists for a lottery agent system which makes available through the electronic network the purchase of governmental lottery tickets and facilities additional features such as subscription play and instant play.

SUMMARY OF THE INVENTION

A system for facilitating governmental lottery play over an electronic network is provided, comprising an agent server connected via said electronic network for receiving player and ticket information transmitted from a plurality of player terminals, for transmitting said ticket information to a governmental lottery administrator, and for receiving serial numbers issued by said governmental lottery administrator in association with each lottery ticket; a database in said agent server for storing said player and ticket information and said serial numbers associated with each lottery ticket; and a screening unit in said agent server, having criteria required by the governmental lottery administrator pre-stored therein, for verifying that each player satisfies said criteria prior to transmitting said ticket information to said governmental lottery administrator.

The system preferably further includes a verification unit in said agent server for receiving winning numbers drawn by a governmental entity and for comparing said winning numbers with said ticket information stored in said database to determine if there are any winning lottery tickets of which numbers match said winning numbers. The verification unit preferably verifies serial numbers of said winning lottery tickets with said serial numbers previously stored in said database.

The ticket information of the above system includes subscription play information, said system further including a subscription play unit for monitoring subscription play of the same lottery numbers for a specified number of draws.

The system further including a banking server and a banking database for storing player account information, said banking server for debiting a player's account when said player purchases a lottery ticket and for crediting said player's account with a winning amount upon a win from said lottery ticket, said banking server for communicating and transmitting debits and credits of money with said governmental lottery administrator. The banking server communicates with a credit card provider of said player and debits and credits a credit card account of said player upon purchase of a lottery ticket or a win from a lottery ticket purchased by said player.

According to an aspect of the invention, the agent server is configured to transmit to said player terminals lottery game data upon confirmation of purchase of a lottery ticket from said governmental lottery administrator, whereby an image in the form of a lottery ticket including ticket numbers selected by said player and said associated serial numbers is displayed on said player terminal of said player. The electronic network is the Internet.

A method is also provided for conducting governmental lottery play over an electronic network, comprising the steps of receiving player and ticket information entered by lottery players; verifying that said lottery players satisfy criteria required by a governmental entity governing said governmental lottery play; storing said player and ticket information of said verified lottery players; receiving serial numbers issued by governmental entity server, each serial number being associated with each lottery ticket; receiving winning numbers from said governmental entity server; determining winning tickets by comparing said winning numbers with ticket numbers entered by said verified lottery players; and verifying said winning tickets with said serial numbers.

The method further including the steps of crediting a winning amount of each winning ticket to an account of each corresponding winning player, and debiting accounts of said verified players for purchases of said lottery tickets. The verification criteria may include a minimum age and residency within border of said governmental entity.

According to an aspect of the invention, the ticket information includes subscription player information including the subscription lottery number and the number of times to be played. The method further includes the steps of monitoring the number of times to be played and stopping when the number of times to be played reaches zero.

The method also includes the steps of transmitting information of said winning tickets to the governmental entity server, said information including said serial numbers associated with said winning tickets; receiving claim validation numbers associated with said winning tickets from the governmental entity server, said claim validation numbers being issued by and stored in the governmental entity server; providing said claim validation numbers to each winning player; claiming a predetermined winning amount by submitting said claim validation numbers; verifying said submitted claim validation numbers with said claim validation numbers stored in the governmental entity server; and rewarding said winning amount to said each winning player.

According to another aspect of the invention, a system for facilitating governmental lottery play over an electronic network is provided, comprising an agent server connected via said electronic network for receiving player and ticket information from a plurality of players, for transmitting said ticket information to said governmental lottery administrator, and for receiving serial numbers issued by said governmental lottery administrator in association with each lottery ticket; a database in said agent server for storing said player and ticket information and said serial numbers associated with each lottery ticket, said ticket information includes lottery numbers for subscription play of the lottery numbers for more than one lottery draw; and a subscription play unit for monitoring the subscription play and putting in play the subscription lottery numbers for a pre-specified number of draws until expiration of a subscription time period.

The system further includes a screening unit in said agent server, having criteria required by the governmental lottery administrator pre-stored therein, for verifying that each player satisfies said criteria prior to transmitting said ticket information to said governmental lottery administrator.

The system also includes means for notifying the player prior to or at the expiration of the subscription time period that play is to end or has ended.

The system further includes a database which includes pre-stored serial numbers associated with instant lottery tickets for facilitating play of instant lottery upon verifying that the player satisfies the criteria by the agent server.

BRIEF DESCRIPTION OF THE DRAWINGS

This disclosure will present in detail the following description of preferred embodiments with reference to the following figures wherein.

DETAILED DESCRIPTION OF PREFERRED EMBODIMENTS

Figure 1:
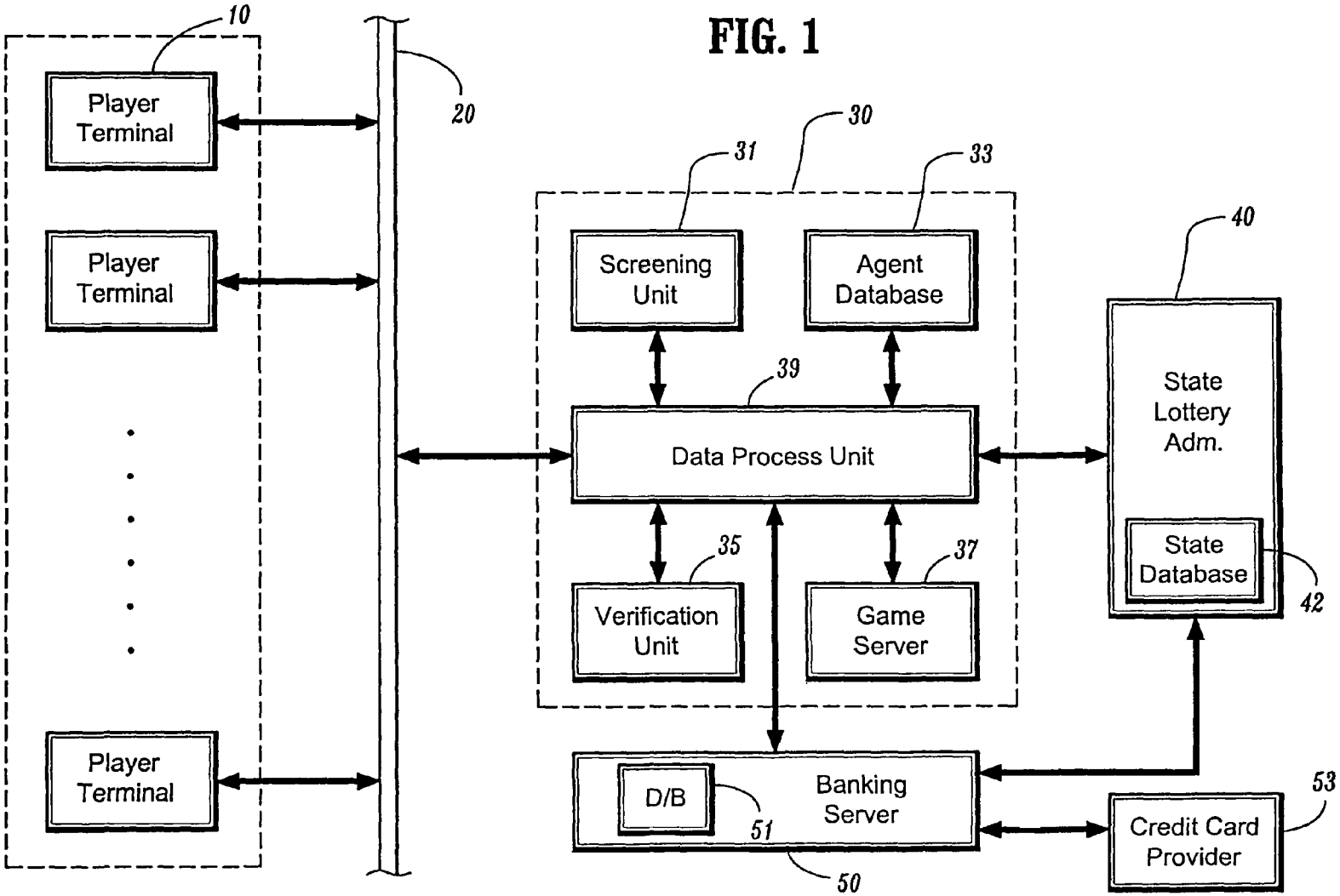
FIG. 1 is a block diagram illustrating a preferred embodiment of a lottery agent system according to the present invention.

The present disclosure describes a lottery agent system for facilitating lottery games which makes it possible to purchase lottery tickets and to play lottery games at player terminals through a communication network. The lottery agent system of the present invention more particularly relates to playing lottery games provided by a governmental entity such as a country, county, state, province or multi-state lottery association (hereafter referred to as "state"). The system includes an agent server for interacting with lottery players and lottery administrators of the states to manage and facilitate the state lottery games. For example, lottery players access the agent server via an electronic network such as the Internet to purchase lottery tickets at the player terminals, such as personal computers or lottery terminals, for playing lottery games. The lottery players enter player information, such as names, addresses, ages, and accounts of the lottery players, and ticket information of the lottery tickets to be purchased. The types of games include the traditional periodic games (which draw winning numbers twice a week, weekly or monthly etc.), instant games wherein players learn whether they have won nearly instantaneously, or subscription games. The players purchase lottery on a subscription basis by entering subscription play information such as the lottery numbers, the amount of wager, and the duration or number of plays using the lottery numbers. The accounts may be credit card accounts or bank accounts of the lottery players, or separate accounts or other payment method such as prepaid account cards established by the agent server for the lottery players for the use of lottery games. Upon receiving the player and ticket information, the agent server verifies based on the player information of the lottery players that each lottery player satisfies certain criteria required by the state.

After such verification of the lottery players, the agent server sends the ticket information via the Internet to each state lottery administrator which then provides the agent server with security or serial numbers associated with each lottery ticket purchased. The security or serial numbers (hereinafter referred to as "serial numbers") are preferably encrypted numbers. Each ticket sold is assigned a unique serial number by the state. In the case of instant lottery games, the instant tickets and associated serial numbers are pre-stored in a database at the agent server. The agent server transmits lottery game data to the player terminals of the lottery players upon confirmation of the purchase of the lottery tickets.

Upon drawing winning numbers, the agent server verifies winning tickets of which ticket numbers match the winning numbers, based on the serial numbers received from the state lottery administrator. The agent server then notifies the lottery players of the verified winning tickets.

The agent server also transmits to the state lottery administrator the ticket information of the winning tickets including the serial numbers associated with the winning tickets. The state lottery administrator verifies the ticket information received from the agent server with the ticket information previously stored in a state database. Upon a successful verification, the state lottery administrator issues claim validation numbers associated with the verified winning tickets for the future claims on lottery awards by winning players. The claim validation numbers issued by the state lottery administrator are stored in the state database and transmitted to the agent server.

The lottery agent system may also include a banking server which interacts with the agent server and the each state lottery administrator and credits an account of each winning player with a winning amount provided by the each state administrator and debits the account for purchase of the lottery tickets.

Thus, a lottery agent system of the present invention performs a screening and a verification process. Preferably, upon receiving the player and ticket information, the agent server screens each lottery player for satisfaction of criterias set by the states. Upon purchase of a ticket, the serial number associated with each ticket is stored. Upon a drawing of winning numbers, the agent server verifies winning tickets with the player's information, serial numbers and validation numbers issued by each state administrator and stored in a database of the agent server.

FIG. 1 shows a preferred embodiment of a lottery agent system according to the present invention. Player terminals 10 are used by lottery players to enter information for playing lottery games. The player terminals 10 may be personal computers of the lottery players and/or lottery terminals specifically for playing lottery games and located at readily accessible places. To purchase lottery tickets, the lottery players enter at the player terminals 10 player information, such as age and address, account number of the player, and ticket information, such as types and numbers of lottery tickets to be purchased, including specifying instant play or subscription play as a subscriber. The player and ticket information is transferred via a communication network 20 to an agent server 30. The communication network 20 is preferably a global electronic network such as the Internet through which a lottery website is provided for the lottery players to log on.

The agent server 30 includes a plurality of program modules having stored codes executable by a data process unit 39 for effecting agent server functions including communicating over the electronic network. Other modules include a screening unit 31 for verifying based on the player information that each lottery player satisfies certain criteria required for playing lottery games, an agent database 33 for storing the player and ticket information and serial numbers generated by a state lottery administrator 40, a verification unit 35 for verifying winning tickets based on the ticket information and the serial numbers after a drawing of winning numbers, a game server 37 for storing and providing various types of lottery games. The data process unit 39 also communicates control and data signals with the above and other components of the agent server 30. The game server 37 includes a subscription play unit (not shown) for monitoring subscription play and putting in play the subscription lottery numbers for a pre-specified number of draws until expiration of the specified subscription time period. Detail description of the agent server 30 in FIG. 1 follows.

When a lottery player enters his/her player and ticket information at a player terminal 10 to purchase lottery tickets, the screening unit 31 receives the player and ticket information and verifies based on the player information that the lottery player satisfies certain criteria required by the state. The criteria, for example, minimum age and residency within the border of the state, are set by the state as a condition to purchase lottery tickets. Such criteria may be previously stored in the screen unit 31. For the verification, the screening unit 31 compares the criteria with the player information to confirm that each and every requirement of the criteria is satisfied with each corresponding data of the player information. For example, the screen unit 31 may perform comparison and determination with respect to whether the lottery player's age is over the minimum age, whether the lottery player's address falls within the border of the state, and so on. If the player information is successfully verified by the screening unit 31, the verified player information along with the ticket information is stored in the agent database 33 under the control of the data process unit 39. Upon such verification, the ticket information is transmitted to the state lottery administrator 40 under the control of the data process unit 39. Upon receiving and storing the ticket information in a state database 42, the state lottery administrator 40 issues serial numbers associated with the lottery tickets to be purchased in accordance with the ticket information. Each of the serial numbers is associated with each of the lottery tickets to be purchased. That is, each serial number is unique to each lottery ticket to be purchased. The serial numbers are then transmitted to and stored in the agent database 33 under the control of the data process unit 39. In the case of instant lottery games, winning numbers can be pre-drawn and the serial numbers associated with tickets pre-stored in the agent server. Thus, the instant ticket can be presented to the player immediately upon verification of player information.

Upon receiving the serial numbers associated with the lottery tickets from the state lottery administrator 40, the data process unit 39 confirms the purchases of the lottery tickets and generates control signals to the game server 37 for playing lottery games. In response to the control signals from the data process unit 39, the game server 37 provides the player terminal 10 with image data in the form of the lottery tickets purchased. The player terminal 10 displays on its screen virtual lottery tickets corresponding to the image data of the lottery tickets purchased. The image data may include ticket numbers selected by the lottery player and the serial numbers associated with the lottery tickets. The game server 37 may previously store image data of various types of lottery tickets. The lottery player can then play lottery games with the virtual lottery tickets displayed on the player terminal 10. That is, the lottery player observes a drawing of winning numbers and matches between the winning numbers and the ticket numbers of the virtual lottery tickets. The lottery player can also interactively communicate with the agent server 30 via the Internet 20 while playing lottery games.

The players can also select subscription play from the types of games made available to players from agent server 30. A player selects from the website operated by the agent server 30 the subscription play icon. A subscription form appears to prompt the player to enter subscription play information such as the number of plays, the actual numbers to be played, and the amount of wager per play, etc. The subscription information received by agent server 30 is stored in database 33. A subscription play unit (not shown) in game server 37 monitors the subscription play data stored in database 33. For example, if the number of plays entered by the subscriber player is weekly play, the subscription play unit, in connection with data process unit 39 and agent database 33, will put in play the actual numbers selected by the player (stored in database 33) each week. The subscription play unit also monitors the specific number of plays by counting down by one each time the lottery numbers are played until the specified number of play becomes zero. The subscription play unit preferably generates a 'subscription play complete' flag and the player is notified of the completion of subscription play by agent server 30. Preferably, the flag is generated prior to or at the expiration of the number of plays or the specified time period and the subscriber player is notified prior to or at the end of subscription play. The notification can be sent by email or sent to the account of the player which the player can access over the global electronic network.

After winning numbers are drawn from each game, the state lottery administrator 40 provides the winning numbers to the agent server 30 or the winning numbers are entered into the agent server 30 after they are publicly announced. The verification unit 35 receives the winning numbers and determines if there are any winning lottery tickets of which ticket numbers match the winning numbers. For the determination, the verification unit 35 accesses the ticket information stored in the agent database 33 which includes the ticket numbers of the lottery tickets purchased. The verification unit 35 then compares the respective ticket numbers with the winning numbers to determine the winning lottery tickets.

Upon determining the winning lottery tickets, the verification unit 35 verifies the winning lottery tickets with the serial numbers previously issued by the state lottery administrator 40. For the verification, the verification unit 35 accesses the serial numbers stored in the agent database 33. Since each of the serial numbers is previously issued in association with each of the purchased lottery tickets and stored in the agent database 33, each of the winning lottery tickets can be verified by confirming the serial numbers of the winning lottery tickets with the corresponding serial numbers retrieved from the agent database 33.

Upon being successfully verified with the corresponding serial numbers, information of the winning lottery tickets including the serial numbers are transmitted from the agent database 33 to the state lottery administrator 40 under control of the data process unit 39. Upon receiving the information and the serial number of the winning tickets, the state lottery administrator 40 issues claim validation numbers associated with the winning tickets. Each of the claim validation numbers is unique to each of the winning tickets. The issued claim validation numbers are stored in the state database 42.

The claim validation numbers are transmitted from the state lottery administrator 40 and stored in the agent database 33 under control of the data process unit 39. The agent server 30 also provides the claim validation numbers to the player terminals 10 of the winning players. Upon receiving the claim validation numbers, the winning players are qualified to claim predetermined lottery awards. That is, the winning players can print a claim form including the claim validation numbers at the player terminals 10, and then claim the predetermined lottery awards by completing and submitting the claim form to the state lottery administrator 40. Upon receiving the claim form with the claim validation numbers, the state lottery administrator 40 accesses the corresponding claim validation numbers previously stored in the state database 42 to verify the claim form and the claim validation numbers received. After successful verification of the claim form and the claim validation numbers, the state lottery administrator 40 allows the banking server 50 to reward the predetermined lottery awards under control of the data process unit 39 to the claimants, i.e., the winning players.

The lottery agent system of the present invention further includes the banking server 50 for crediting and debiting the accounts of the lottery players. The accounts for the use of playing lottery games may be credit card accounts or bank accounts of the lottery players, or separate accounts previously established for the lottery players. Such accounts may be stored in the database 51 of the banking server 50. The player can also purchase prepaid cards, which are similar to prepaid phone cards wherein the cards bear a credit or sum of money to be subtracted down each time a player purchases a ticket. The prepaid cards can be in different denominations purchased at convenience stores by cash or check or online with a credit card. The prepaid card preferably bears a user-id number which the player can enter for identification and proper debiting/crediting by the agent server. The banking server 50 credits the accounts of the respective lottery players who own the winning tickets and claim predetermined lottery awards, and debits the accounts of the respective lottery players for the purchases of the lottery tickets. At the time of every credit or debit, the banking server 50 updates the corresponding accounts in the banking database 51. The banking server 50 may directly communicate with credit card providers 53 of the lottery players. That is, the banking server 50 debits and credits credit card accounts of the lottery players upon purchases of the lottery tickets or wins from the lottery tickets purchased.

Figure 2A:
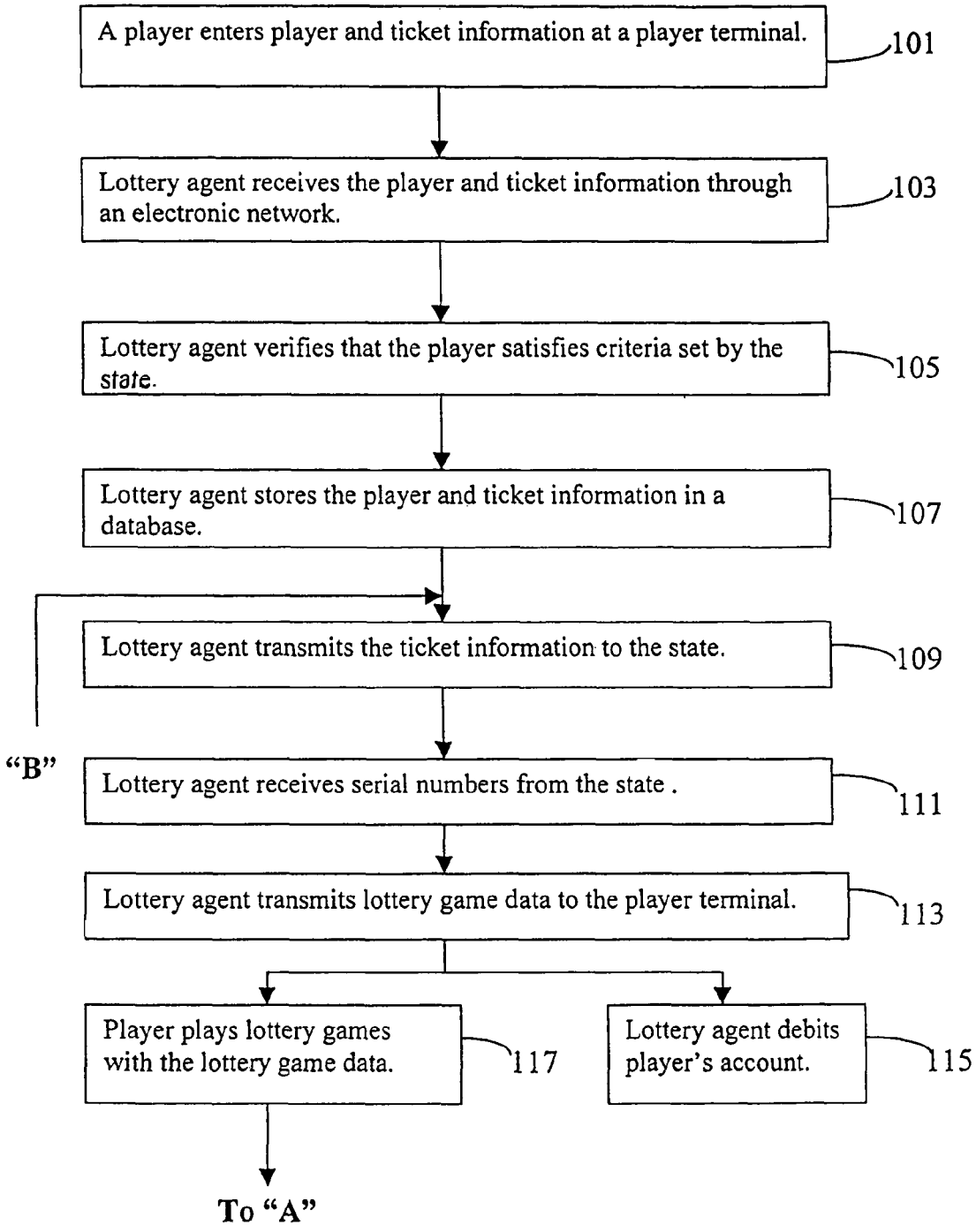
FIGS. 2A and 2B are flow charts describing a method for operating on-line state lottery games according to the present invention.
Figure 2B:
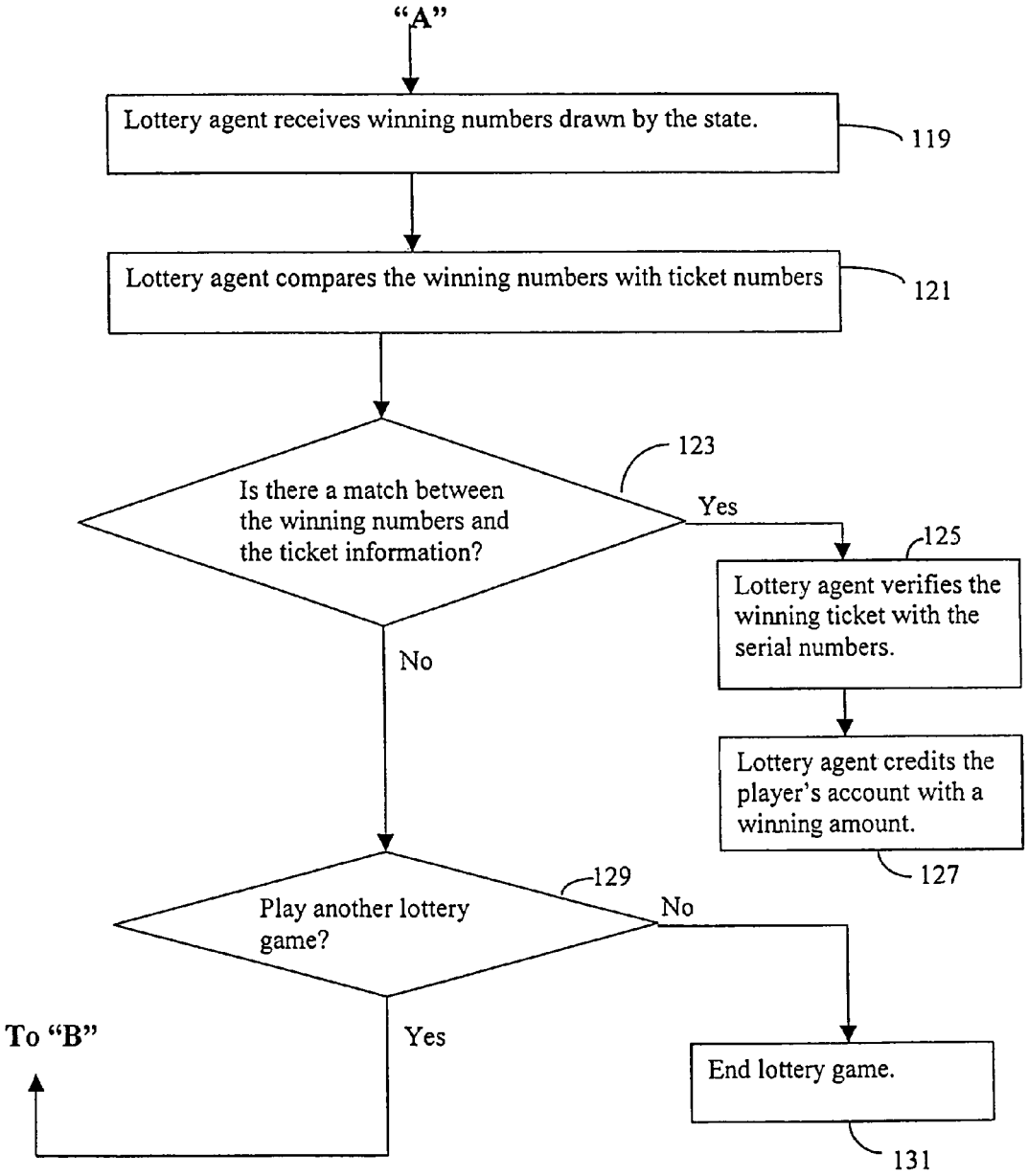

Referring to FIGS. 2A and 2B, a flowchart illustrates a method for facilitating play of on-line state lottery games. To purchase lottery tickets, a lottery player enters his/her player information and ticket information at a player terminal (step 101). The player information may include name, age, address, and account information of the lottery player. The ticket information includes types and numbers of the lottery tickets to be purchased by the lottery player. A lottery agent receives the player and ticket information through an electronic network, such as the Internet (step 103), and verifies that the lottery player satisfies certain criteria required by the state to purchase the state lottery tickets (step 105). For example, the state may require in the criteria that a lottery player must be at least 18 years old and resident in the state.

The lottery agent stores the player and ticket information of the verified player in a database (step 107), and transmits the ticket information to the state, i.e., a state lottery administrator (step 109). The state lottery administrator then issues serial numbers associated with the ticket information after confirming the purchase of the state lottery tickets by the lottery player (step 111). The issued serial numbers, each of which is unique to each of the purchased lottery tickets, are transmitted to the lottery agent. In the case of instant games, the serial numbers can be pre-stored in the database of the agent server for retrieval by the agent server and presented to the player without communication by the agent server to the governmental administrator. After receiving the serial numbers, the lottery agent transmits to the player terminal lottery game data including image data of the lottery tickets (step 113), and at the same time the lottery agent debits the player's account for the purchase of the lottery tickets (step 115) with the lottery game data, the player terminal displays virtual lottery tickets corresponding to the lottery tickets purchased including ticket numbers selected by the player and associated with the serial numbers. The player then plays a lottery game with the virtual lottery tickets displayed on the player terminal (step 117).

After winning numbers are drawn by the state and transmitted to the lottery agent (step 119), the lottery agent compares the winning numbers with the ticket numbers selected by the lottery player (step 121). If there is any match between the winning numbers and the ticket numbers (step 123), the lottery agent verifies the winning ticket with the serial numbers received from the state lottery administrator (step 125). With respect to the verified winning ticket, the lottery agent credits the player's account with a winning amount provided by the state lottery administrator (step 127). If there is no match between the winning numbers and the ticket numbers in the step 123, the lottery agent asks the lottery player whether to play another lottery game (step 129). If the lottery player chooses not to continue the lottery game, the lottery agent ends the player's lottery game (step 131). If the lottery player chooses to play another lottery game, the lottery agent again transmits the ticket information to the state lottery administrator (step 109). Then, the state lottery administrator issues new serial numbers associated with new lottery tickets and provides the new serial numbers to the lottery agent (step 111). Upon receiving the new serial numbers, the lottery agent repeats the steps 113 to 131 as described above.

Figure 3:
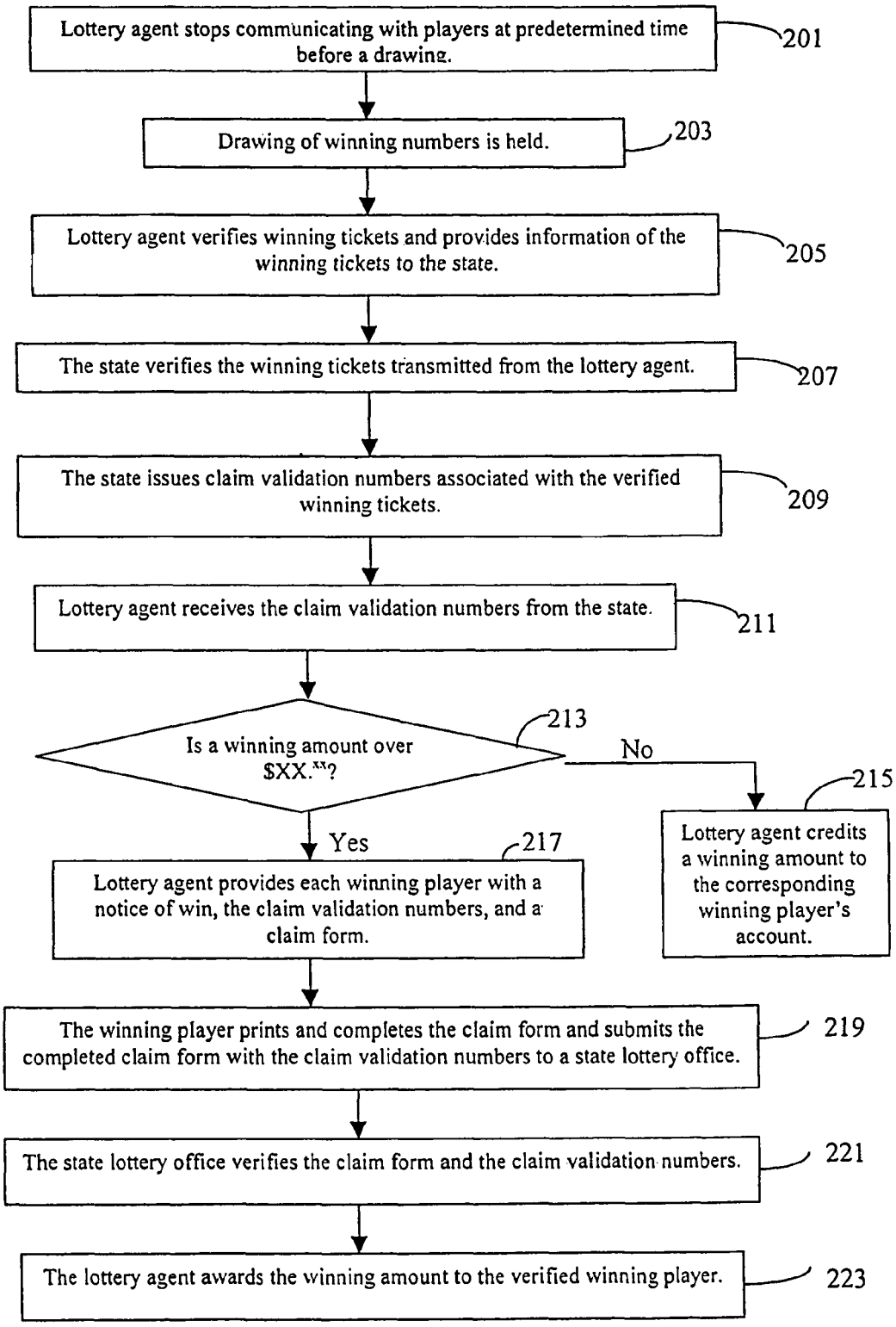
FIG. 3 is a flow chart describing a series of steps for claiming awards for winning lottery tickets.

Referring to FIG. 3, a flow chart illustrates a series of steps for claiming awards for wins in playing lottery games. At a predetermined time before a drawing of winning numbers, a lottery agent managing the lottery games stops communicating with lottery players (step 201). Thus, the lottery players cannot purchase lottery tickets after a predetermined time before a drawing of the winning numbers. After the winning numbers are drawn so that winning tickets are determined (step 203), the lottery agent verifies the winning tickets with the ticket information previously provided by the lottery player and provides the information of the winning tickets to the state (step 205). The verification of the winning tickets includes confirming the winning tickets with serial numbers previously issued by the state in association with the respective winning tickets.

Upon receiving the information of the winning tickets, the state verifies the winning tickets with the ticket information previously stored in a database of the state (step 207). The state then issues claim validation numbers each of which is associated with each of the verified winning tickets (step 209). The claim validation numbers are stored in the state and transmitted to the lottery agent (step 211).

Upon receiving the claim validation numbers associated with the winning tickets, the lottery agent determines whether a winning amount of each winning ticket is over a certain amount of money (step 213). If the winning amount is not over a certain amount of money, the lottery agent credits the winning amount to an account of the corresponding winning player (step 215). If the winning amount is over a certain amount of money, the lottery agent provides each winning player with a notice of win, the claim validation numbers, and a claim form, preferably, via the Internet (step 217). The winning player then prints and completes the claim form and submits the completed claim form with the claim validation numbers to a state lottery office administering the state lottery games (step 219). The state lottery office verifies the claim validation numbers submitted by the winning player with the corresponding claim validation numbers previously stored in the state (step 221). Upon verifying the claim validation numbers, the state allows the lottery agent to award the winning amount to the winning player (step 223).

Thus, the system and the method for operating on-line state lottery games according to the present invention provides the lottery players with not only convenient and readily accessible lottery play but also more reliable security on the information for playing the state lottery games. Therefore, the present invention may facilitate lottery games so as to encourage patrons to play lottery games more frequently.

Having described preferred embodiments of a system and a method for playing electronic lottery games according to the present invention, it is noted that modifications and variations can be made by persons skilled in the art in light of the above teachings.

It is also to be understood that the above embodiments are intended to be illustrative, and that any changes may be made in the particular embodiments disclosed, which are within the scope and spirit of the invention as outlined by the appended claims.

What is claimed is:

1. A system for facilitating lottery play over the Internet, comprising:

an agent server connected via the Internet configured to receive player and ticket information transmitted from a plurality of player terminals, transmit said ticket information to a separate lottery administrator server, receive serial numbers generated by said lottery administrator server in association with each lottery ticket, and send to the player terminals the serial numbers associated with the tickets;

a database in said agent server configured to store said player and ticket information and said serial numbers associated with each lottery ticket; and a screening unit in said agent server, having criteria required by a lottery administration entity pre-stored therein, configured to verify that each player satisfies said criteria prior to transmitting said ticket information to said lottery administrator server.

2. The system according to claim 1, further including a verification unit in said agent server for receiving winning numbers drawn by the lottery administration entity and for comparing said winning numbers with said ticket information stored in said database to determine if there are any winning lottery tickets of which numbers match said winning numbers.

3. The system according to claim 2, wherein said verification unit verifies serial numbers of said winning lottery tickets with said serial numbers previously stored in said database.

4. The system according to claim 1, wherein said ticket information includes subscription play information, said system further including a subscription play unit for monitoring subscription play of the same lottery numbers for a specified number of draws.

5. The system according to claim 1, further including a banking server and a banking database for storing player account information, said banking server for debiting a player's account when said player purchases a lottery ticket and for crediting said player's account with a winning amount upon a win from said lottery ticket, said banking server for communicating and transmitting debits and credits of money with said lottery administration entity.

6. The system according to claim 5, wherein said banking server communicates with a credit card provider of said player and debits and credits a credit card account of said player upon purchase of a lottery ticket or a win from a lottery ticket purchased by said player.

7. The system according to claim 1, wherein said criteria includes a minimum age and residency within the border of the lottery administration entity.

8. The system according to claim 1, wherein said agent server is configured to transmit to said player terminals lottery game data upon confirmation of purchase of a lottery ticket from said lottery administration entity, whereby an image in the form of a lottery ticket including ticket numbers selected by said player and said associated serial numbers is displayed on said player terminal of said player.

9. The system according to claim 1, wherein said database includes pre-stored serial numbers associated with instant lottery tickets for facilitating play of instant lottery upon verifying that the player satisfies the criteria by the agent server.

10. A method for conducting lottery play over the Internet, comprising the steps of:

receiving at an agent server player and ticket information entered by lottery players;

verifying that said lottery players satisfy criteria required by an entity administering said lottery play;

storing said player and ticket information of said verified lottery players;

receiving at the agent server serial numbers generated by a separate lottery administration server, each serial number being associated with each lottery ticket;

forwarding from the agent server the serial numbers to the players;

receiving winning numbers from said lottery administration server;

determining winning tickets by comparing said winning numbers with ticket numbers entered by said verified lottery players; and verifying said winning tickets with said serial numbers.

11. The method according to claim 10, further including the step of crediting a winning amount of each winning ticket to an account of each corresponding winning player.

12. The method according to claim 10, further including the step of debiting accounts of said verified players for purchases of said lottery tickets.

13. The method according to claim 10, wherein said criteria includes a minimum age and residency within a jurisdiction associated with said entity administering said lottery play.

14. The method according to claim 10, wherein the ticket information includes subscription play information including a subscription lottery number and a number of times to be played.

15. The method according to claim 14, further including the steps of monitoring the number of times to be played and stopping lottery play when the number of times to be played reaches zero.

16. The method according to claim 10, further includes the steps of:

transmitting information of said winning tickets to the lottery administration server, said information including said serial numbers associated with said winning tickets; and receiving claim validation numbers associated with said winning tickets from the lottery administration server, said claim validation numbers being issued by and stored in the lottery administration server.

17. The method according to claim 16, further including the steps of:

providing said claim validation numbers to each winning player;

claiming a predetermined winning amount by submitting said claim validation numbers;

verifying said submitted claim validation numbers with said claim validation numbers stored in the lottery administration server; and rewarding said winning amount to said each winning player.

18. The method according to claim 10, further including the step of:

pre-storing serial numbers associated with instant lottery tickets for facilitating play of instant lottery upon verifying that the lottery player satisfies the criteria.

19. A system for facilitating lottery play over the Internet comprising:

an agent server configured to receive via the Internet player and ticket information from a plurality of players, transmit said ticket information to a separate lottery administration server, receive serial numbers generated by said lottery administration server in association with corresponding lottery tickets and forward the serial numbers to the players;

a database in said agent server configured to store said player and ticket information and said serial numbers associated with corresponding lottery tickets, said ticket information includes lottery numbers for subscription play of the lottery numbers for more than one lottery draw; and a subscription play unit in said agent server configured to monitor subscription play and put in play subscription lottery numbers for a pre-specified number of draws until expiration of a subscription time period.

20. The system of claim 19, further including a screening unit in said agent server, having criteria required by a lottery administrator pre-stored therein, for verifying that each player satisfies said criteria prior to transmitting said ticket information to said lottery administration server.

* * * * *